US011717091B2

(12) United States Patent
Silinski

(10) Patent No.: US 11,717,091 B2
(45) Date of Patent: Aug. 8, 2023

(54) CANOPY ASSEMBLY FOR A CHAIR AND A CHAIR WITH A CANOPY ASSEMBLY

(71) Applicant: Rio Brands, LLC, Watertown, CT (US)

(72) Inventor: Robert John Silinski, Bethel Park, PA (US)

(73) Assignee: ShelterLogic Corp., Watertown, CT (US)

( * ) Notice: Subject to any disclaimer, the term of this patent is extended or adjusted under 35 U.S.C. 154(b) by 0 days.

(21) Appl. No.: 17/230,488

(22) Filed: Apr. 14, 2021

(65) Prior Publication Data

US 2021/0321781 A1 Oct. 21, 2021

Related U.S. Application Data

(60) Provisional application No. 63/010,304, filed on Apr. 15, 2020.

(51) Int. Cl.
*A47C 7/66* (2006.01)
*A47C 4/28* (2006.01)

(52) U.S. Cl.
CPC ..... *A47C 7/66* (2013.01); *A47C 4/286* (2013.01)

(58) Field of Classification Search
CPC ..... A47C 7/66; A47C 4/286
See application file for complete search history.

(56) References Cited

U.S. PATENT DOCUMENTS

| | | | | |
|---|---|---|---|---|
| 3,738,703 | A * | 6/1973 | Kunimatu | A47C 7/66 297/184.15 |
| 4,687,249 | A * | 8/1987 | Mills | A47C 7/66 D34/27 |
| 5,096,257 | A * | 3/1992 | Clark | 135/96 |
| 6,789,557 | B1 * | 9/2004 | Wahl, Jr. | 135/120.2 |
| 7,243,990 | B1 | 7/2007 | Wahl | |

(Continued)

*Primary Examiner* — Anthony D Barfield
(74) *Attorney, Agent, or Firm* — Carmody Torrance Sandak & Hennessey LLP

(57) ABSTRACT

A canopy assembly for a chair, the assembly including a first mounting fixture and a second mounting fixture; a first arm and a second arm, each arm having a first end and a second end, wherein the first end of each arm is coupled to a respective mounting fixture; a first canopy support and a second canopy support, wherein the second end of each arm is coupled to a respective canopy support; a first brace and a second brace, each brace coupled between a respective arm and canopy support, with a first end of each brace being coupled to the respective arm with a slidable coupler so as to permit the rotation of the first and second canopy supports relative to the first and second arms; a cross-member coupled intermediate the first and second canopy supports, for maintaining the first and second canopy support at a predetermined spaced distance from each other; and a canopy that is at least supported by the first canopy support and the second canopy support; wherein when the canopy assembly is in a deployed position, the cross-member maintains the first and second canopy supports at the predetermined spaced distance from each other; and when the canopy assembly is in its stowed position, the cross-member maintains the first and second canopy supports at the predetermined spaced distance from each other. A combination canopy assembly and a chair is also disclosed.

7 Claims, 12 Drawing Sheets

(56) References Cited

U.S. PATENT DOCUMENTS

| | | | |
|---|---|---|---|
| 8,186,755 | B2 | 5/2012 | Lovley |
| 9,072,290 | B1 | 7/2015 | McCauley |
| D737,066 | S | 8/2015 | Lovley, II et al. |
| 9,220,347 | B2 | 12/2015 | Lovley, II |
| D774,815 | S | 12/2016 | Lovley, II et al. |
| 2007/0040422 | A1 | 2/2007 | Reeb et al. |

* cited by examiner

CANOPY ASSEMBLY FOR A CHAIR AND A CHAIR WITH A CANOPY ASSEMBLY

BACKGROUND OF THE INVENTION

The present invention relates to a canopy assembly for a chair and a chair with such a canopy assembly, including constructions therefor and methods for assembling the canopy assembly, coupling and decoupling the canopy assembly to and from an article of furniture, such a chair, and improved constructions and arrangements for a canopy assembly and a combination chair and canopy assembly. Although not limited thereto, the improved canopy assembly of the present invention is particularly advantageous for use with outdoor folding chairs, such as beach chairs of the type comprising a U-shaped seat frame, a U-shaped back frame, a U-shaped front leg frame and a U-shaped back leg frame.

Canopies for collapsible chairs are known in the art, for example as described in U.S. Pat. Nos. 8,186,755 and 9,220,347. For example, the described canopy in U.S. Pat. No. 8,186,755 is particularly advantageous for use in connection with a collapsible chair that is illustrated in FIG. 2 of U.S. Pat. No. 8,186,755 and collapsible as illustrated in FIG. 11 of U.S. Pat. No. 8,186,755 and illustrated herein as FIGS. 1 and 1A, respectively. U.S. Pat. No. 8,186,755 also describes a collapsible canopy with a chair of the U-shaped type, as shown in FIG. 2. U.S. Pat. No. 9,220,347 also describes a collapsible cross member for its canopy, as illustrated in FIG. 3 herein.

However, it has been discovered that improvements to such canopy assemblies are desired, especially when used with folding chairs of the type shown above in FIG. 2, i.e. the U-shape folding type. Specifically, it is desirable and has been found to be achievable to improve such canopy assembly constructions by incorporating a different cross-member construction between the canopy supports, which improves the sturdiness and integrity of the canopy in both the stowed and deployed positions when used in connection with the preferred chair construction as disclosed herein. In particular, it is desirable to provide a canopy assembly for a chair and a chair including such a canopy assembly wherein the canopy is maintained in the same shape when the canopy and the chair are in their respective deployed positions and when the canopy and the chair are in their respective stowed positions.

SUMMARY AND OBJECTIVES OF THE INVENTION

It is an objective of the present invention to overcome the deficiencies in the prior art. For example, it is an objective of the present invention to provide a canopy assembly that has increased structural integrity during use/deployment or during storage or transport when used with the preferred chair construction as set forth herein.

It is a particular objective of the present invention to provide a canopy assembly for use with a generally described "U-shaped" folding chair, wherein the canopy assembly has increased structural integrity during use/deployment or during storage or transport of the chair.

It should also be understood that the construction of the chair generally indicated at 100 herein is made with reference to "U-shaped" frame members. This reference to "U-shaped" is understood to be used by those skilled in the art to describe the frame members of the preferred chair disclosed herein. To the extent that there is any ambiguity as to the shape of the frame members of the preferred embodiments herein, the inventor of the present invention intends and deems the disclosed frame members to be considered "U-shaped" members for purposes of claim construction. It should also be understood that the U-shaped frame members disclosed herein to not themselves collapse (i.e. they retain their respective shapes at all times, which can be distinguished from the collapsible nature of the individualized leg structures, back structure, and seat structure as shown in FIG. 1A).

It is another objective of the present invention to provide a chair and canopy assembly as disclosed herein.

The present invention achieves the aforementioned objectives as well as others as disclosed herein and is thus generally directed in a first preferred embodiment to a combination canopy assembly and a chair, wherein the canopy assembly comprises a first mounting fixture and a second mounting fixture each coupled to the chair; a first arm and a second arm, each arm having a first end and a second end, wherein the first end of each arm is coupled to a respective mounting fixture; a first canopy support and a second canopy support, wherein the second end of each arm is coupled to a respective canopy support; a first brace and a second brace, each brace coupled between a respective arm and canopy support, with a first end of each brace being coupled to the respective arm with a slidable coupler so as to permit the rotation of the first and second canopy supports relative to the first and second arms; a cross-member coupled intermediate the first and second canopy supports, for maintaining the first and second canopy support at a predetermined spaced distance from each other; and a canopy that is at least supported by the first canopy support and the second canopy support; wherein when the canopy assembly is in a deployed position, the cross-member maintains the first and second canopy supports at the predetermined spaced distance from each other; and when both the canopy assembly and the chair are in their respective stowed positions, the cross-member maintains the first and second canopy supports at the predetermined spaced distance from each other.

In a specific preferred embodiment, the cross-member is a one (1) piece member and unable to be collapsed between the first and second canopy supports to which the cross member is coupled. Preferably, the cross-member does not include any hinge along the length thereof; and wherein the distance between the first and second canopy supports cannot be decreased from the predetermined spaced distance when the canopy assembly and the chair are in their respective stowed positions.

In yet another preferred embodiment, the present invention is directed to the canopy assembly itself, also for a chair, wherein the assembly comprises a first mounting fixture and a second mounting fixture; a first arm and a second arm, each arm having a first end and a second end, wherein the first end of each arm is coupled to a respective mounting fixture; a first canopy support and a second canopy support, wherein the second end of each arm is coupled to a respective canopy support; a first brace and a second brace, each brace coupled between a respective arm and canopy support, with a first end of each brace being coupled to the respective arm with a slidable coupler so as to permit the rotation of the first and second canopy supports relative to the first and second arms; a cross-member coupled intermediate the first and second canopy supports, for maintaining the first and second canopy support at a predetermined spaced distance from each other; and a canopy that is at least supported by the first canopy support and the second canopy support; wherein when the canopy assembly is in a deployed position, the crossmember maintains the first and second canopy supports at the predetermined spaced distance from each other; and when the canopy assembly is in its stowed position, the cross-member maintains the first and second canopy supports at the predetermined spaced distance from each other.

Similarly, in a preferred embodiment, the cross-member is a one (1) piece member and unable to be collapsed between the first and second canopy supports to which the cross member is coupled. Again, and preferably, the cross-member does not include any hinge along the length thereof; wherein the distance between the first and second canopy supports cannot be decreased from the predetermined spaced distance when the canopy assembly is in its stowed position.

In each of the preferred embodiments, the chair comprises a frame and wherein the frame is comprised of a U-shaped seat frame coupled to a U-shaped back frame, a U-shaped front leg frame coupled to a U-shaped back leg frame, and together being coupled to a first arm rest and a second arm rest at respective ends of said U-shaped front leg frame and U-shaped back leg frame, wherein the first and second arm rests are pivotally coupled at respective first ends to the U-shaped back frame; and a coupler for coupling the U-shaped back frame to the U-shaped back leg frame; wherein the U-shaped front leg frame is coupled to the U-shaped seat frame, and wherein the U-shaped back frame, the U-shaped seat frame, the U-shaped front leg frame, and the U-shaped back leg frame are foldable towards each other.

BRIEF DESCRIPTION OF THE DRAWINGS

The above set forth and other features of the present invention are made more apparent in the ensuing Description of the Preferred Embodiments when read in conjunction with the attached drawings, wherein.

DETAILED DESCRIPTION OF THE PREFERRED EMBODIMENTS

Figure 1:
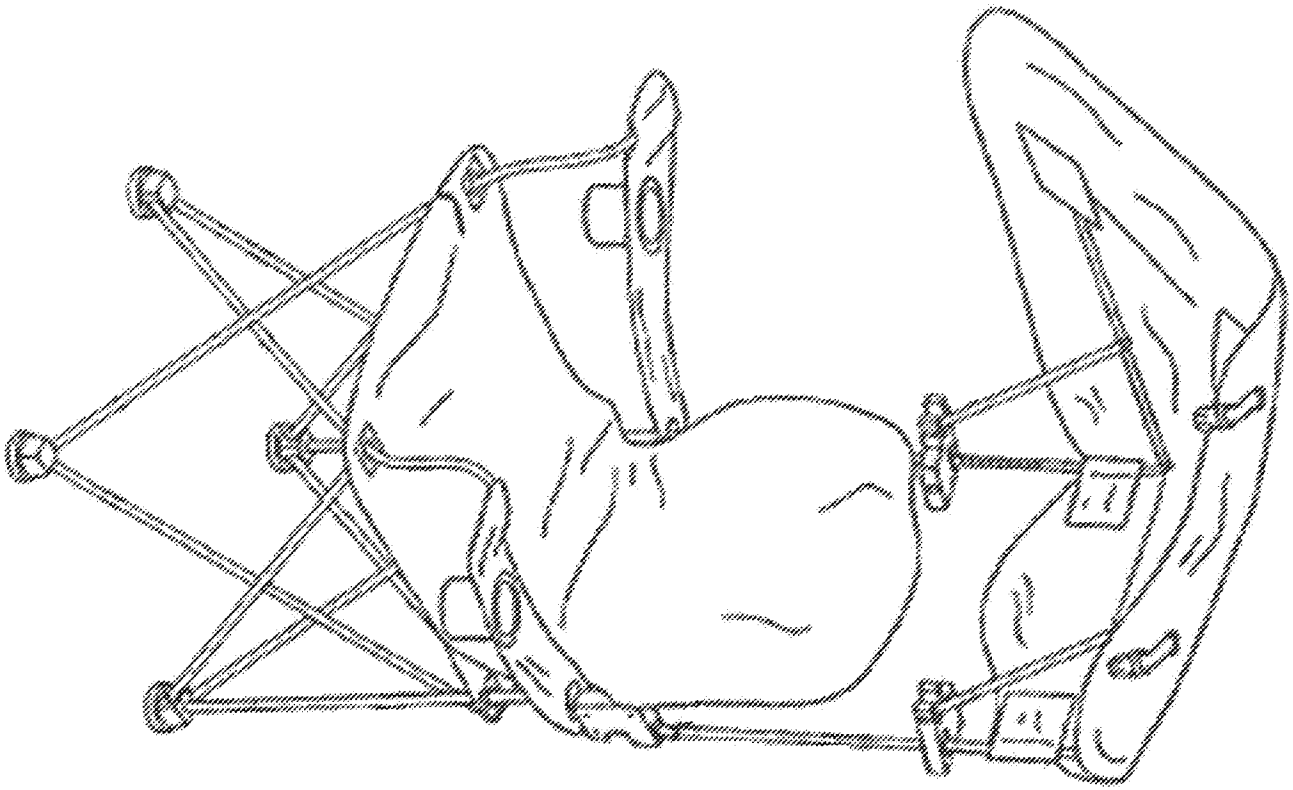
FIG. 1 is a view of a chair and canopy combination as described in the prior art.
Figure 1A:
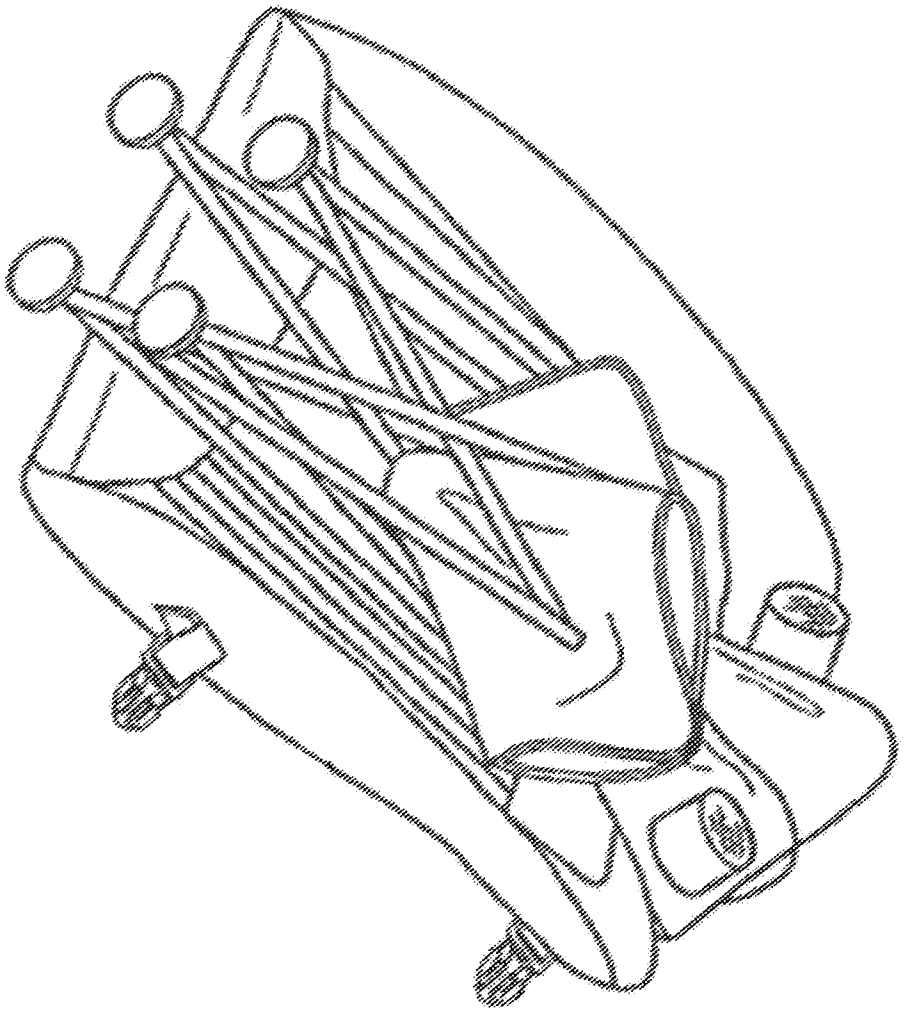
FIG. 1A is a view of the chair and canopy of FIG. 1 in their respective stowed positions.
Figure 2:
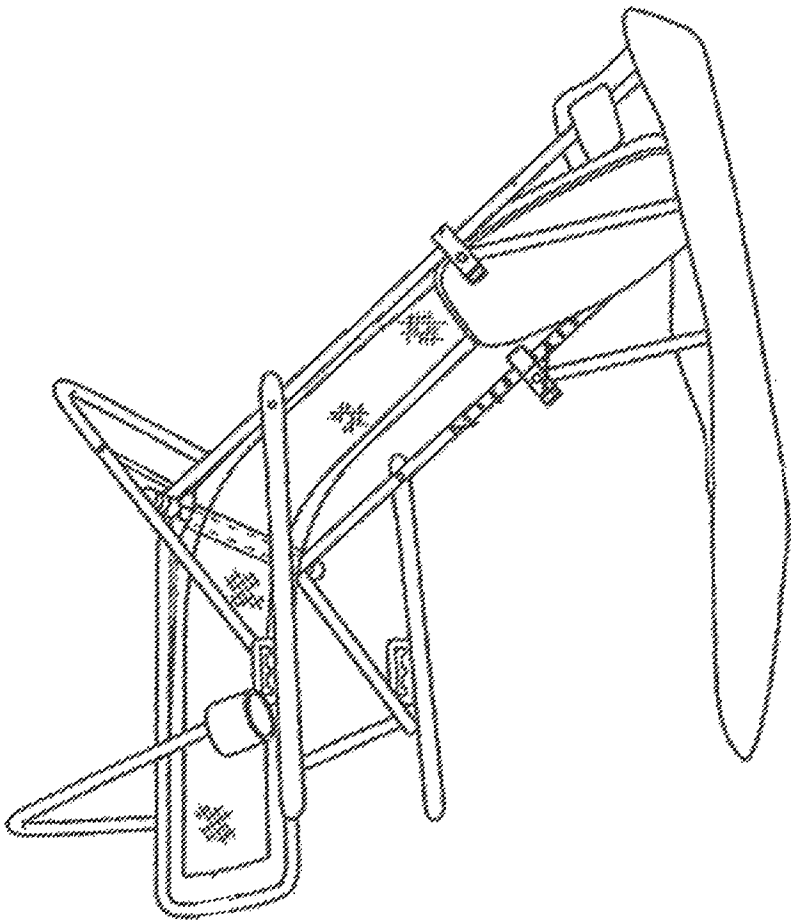
FIG. 2 is a view of a chair and canopy combination as described in the prior art.
Figure 3:
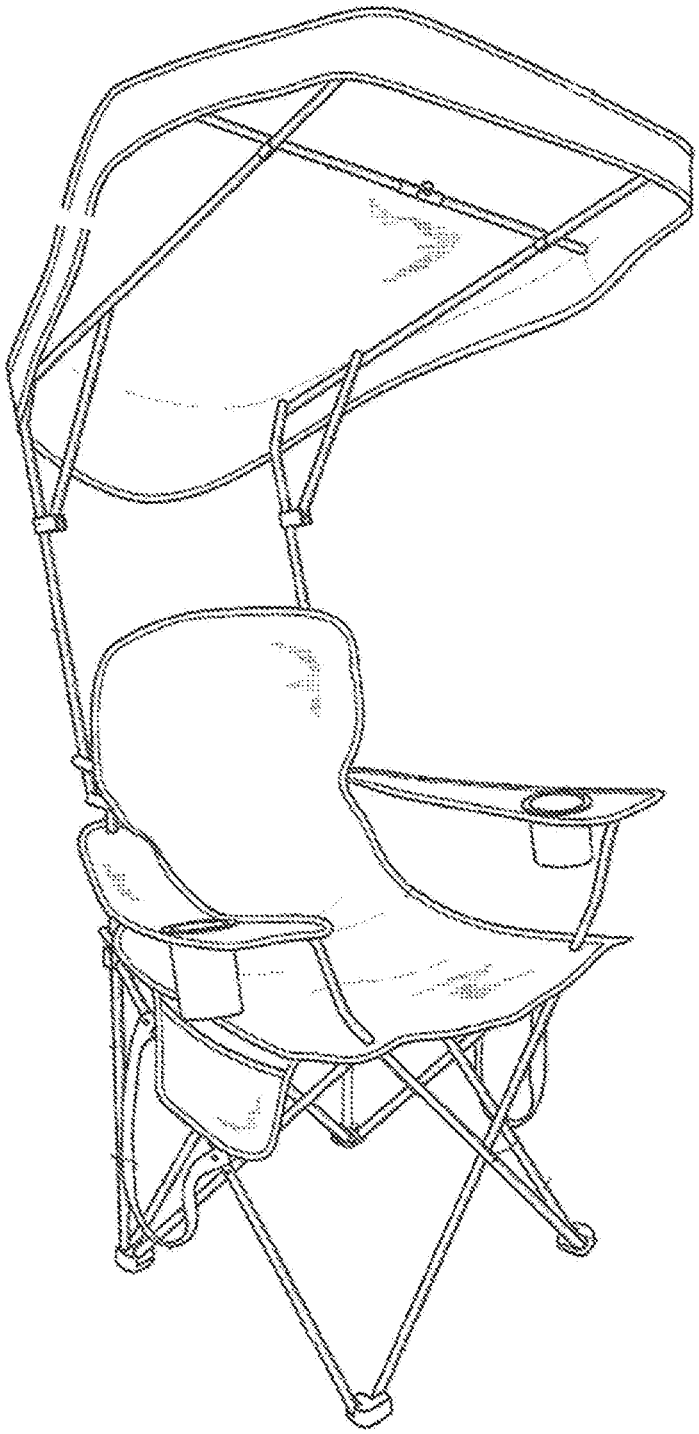
FIG. 3 is a view of a chair and canopy combination as described in the prior art.

Reference is now made to FIGS. 4-11 and the following text for a disclosure of an improved canopy assembly and uses, advantages thereof, comprising among other things, a preferred cross-member, constructed in accordance with preferred embodiments of the present invention.

By way of a preferred construction of a chair with which the canopy assembly of the present invention is used herein, reference is made generally to FIGS. 4-11, which generally disclose a preferred chair, generally indicated at 100, comprising a frame preferably comprised of metal, metal alloy, plastic and/or combinations of the foregoing, wherein the frame preferably comprises a U-shaped seat frame 105 rotatably coupled to a U-shaped back frame 110. Also provided is a U-shaped front leg frame 115 and a U-shaped back leg frame 120. The U-shaped front leg frame 115 is pivotally coupled to the U-shaped seat frame 105 at a pivot 120, and the U-shaped front leg frame 115 is also coupled to the U-shaped back leg frame 120 as disclosed below but also known in the art.

Figure 10:
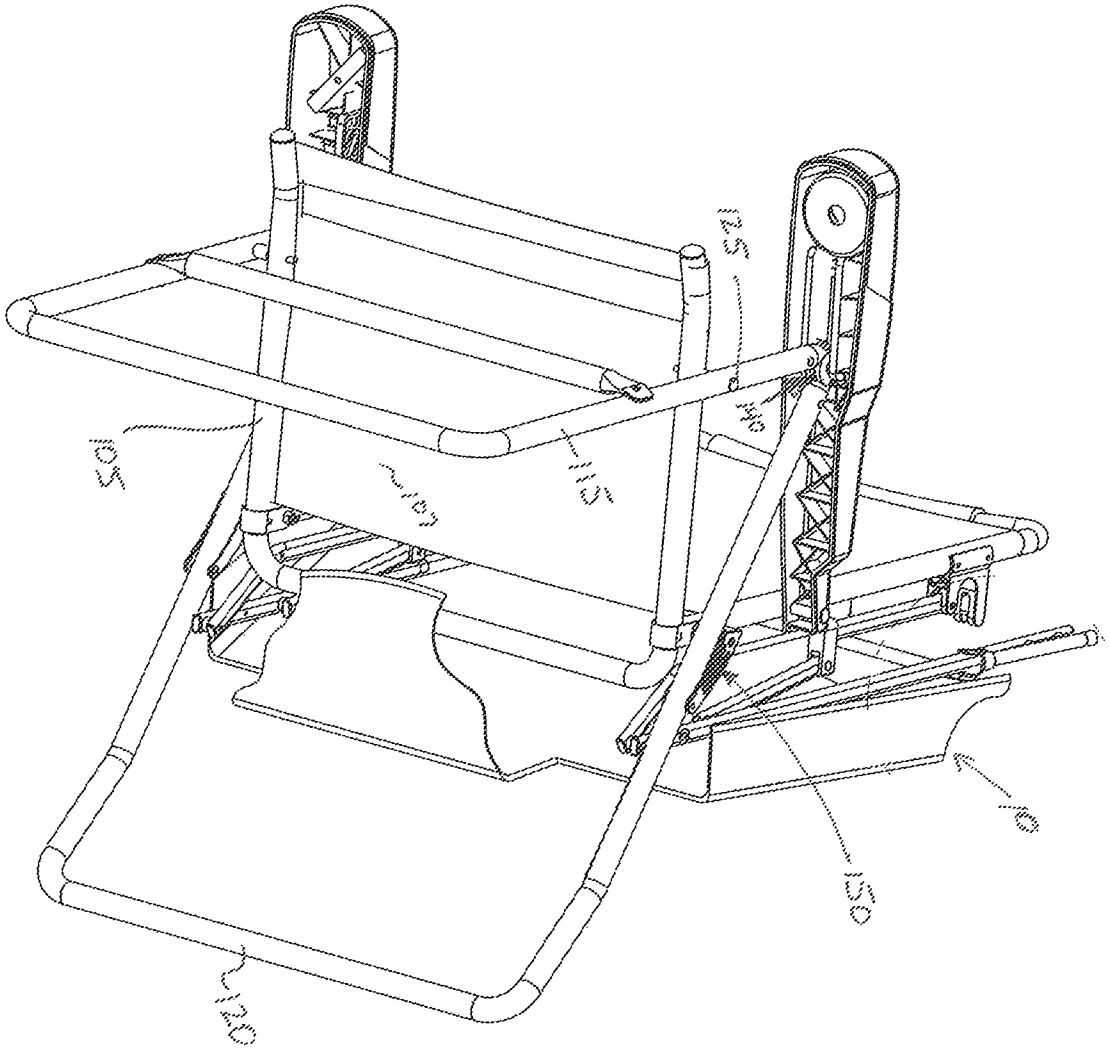
FIG. 10 is yet another view highlighting aspects of a chair and the canopy assembly shown in FIG. 4 as it is moving to/from its stowed position.

The preferred folding chair has a pair of arm rests 130A, 130B that are pivotally coupled at respective first ends to the U-shaped back frame 110 on each side, and the arm rests are also adjustably positionable relative to the coupled together ends of the U-shaped front leg frame and the U-shaped back leg frame as disclosed in FIG. 10, for example. As also illustrated in the Figures, the ends of the U-shaped front leg frame 115 and the U-shaped back leg frame 120 are rotatably coupled together, as each end is coupled to a coupler 140 that itself is provided with shoulders (not shown) that are selectively received in one or more slots provided in the underside of each arm rest 130A, 130B. In this way, the U-shaped seat frame 105 can be positioned in a plurality of reclining and/or upright) positions, as would be understood in the art and/or shown in the Figures.

A coupling assembly generally indicated at 150 is also preferably provided on each side of the chair 100 to couple an end of the U-shaped back frame 110 to an end of the U-shaped seat frame 105, and together which are pivotally coupled to U-shaped back leg frame 120 by a coupler 155. The preferred folding chair 100 also preferably comprises a back support panel 112 coupled to the U-shaped back frame 110 and a seat panel 107 coupled to the U-shaped seat frame 105 in any one of a number of known manners.

Figure 7:
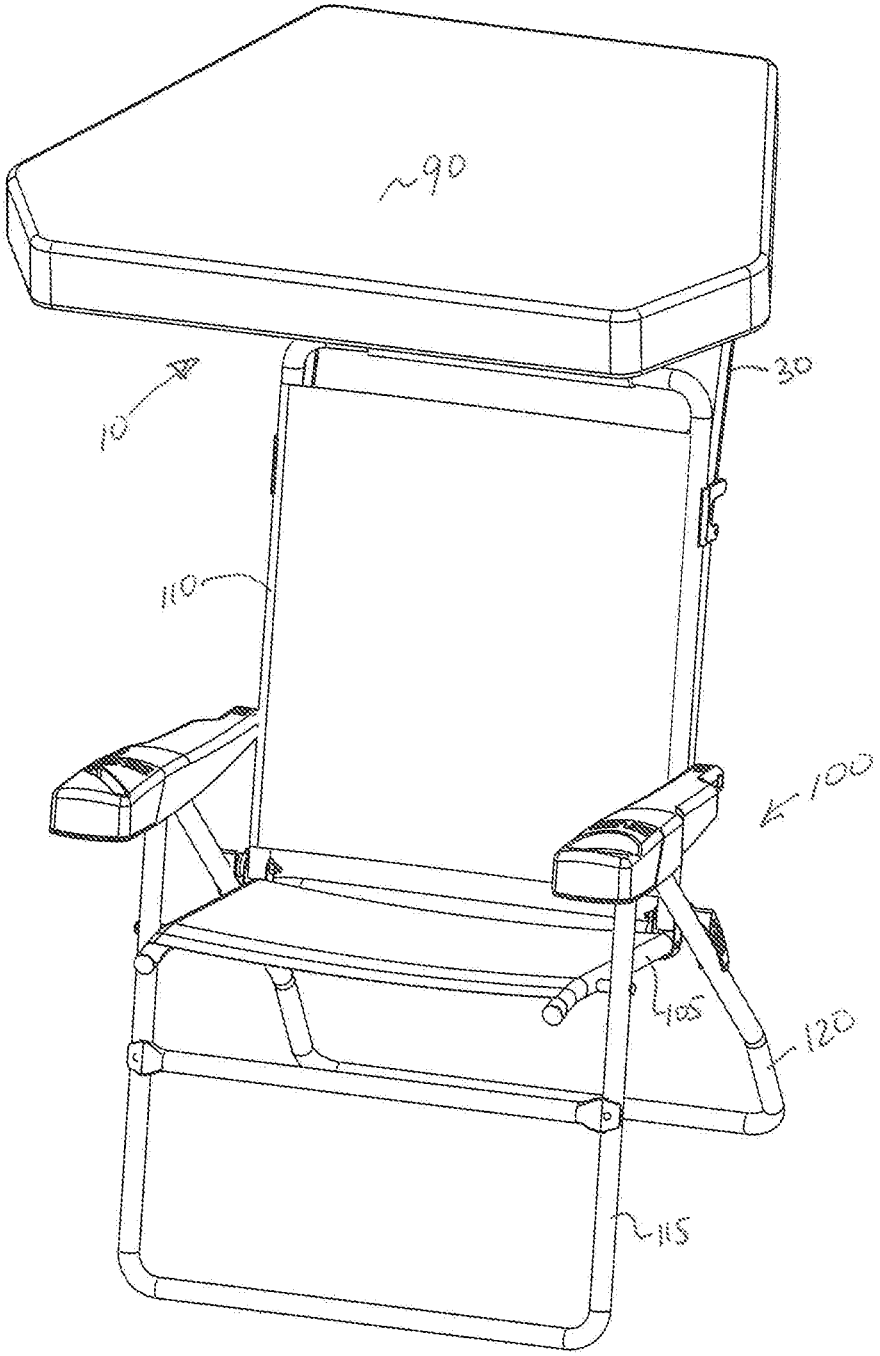
FIG. 7 is yet another view highlighting aspects of the canopy assembly shown in FIG. 4.
Figure 8:
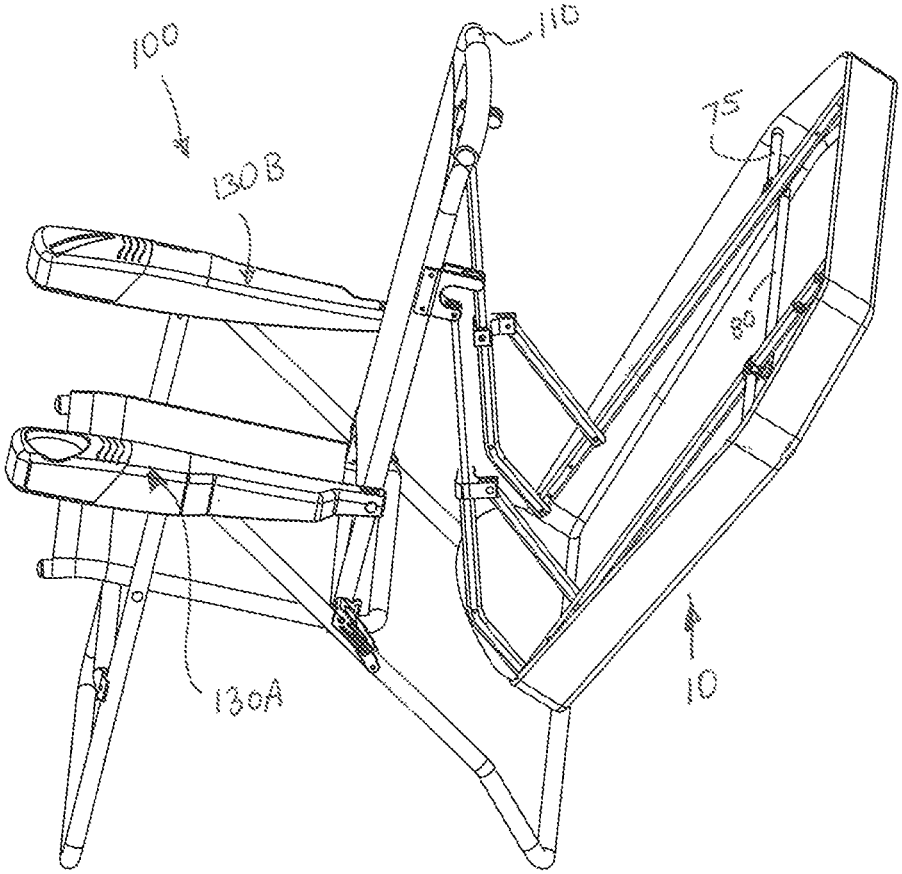
FIG. 8 is yet another view highlighting aspects of the canopy assembly shown in FIG. 4 as it is moving to/from its stowed position.
Figure 9:
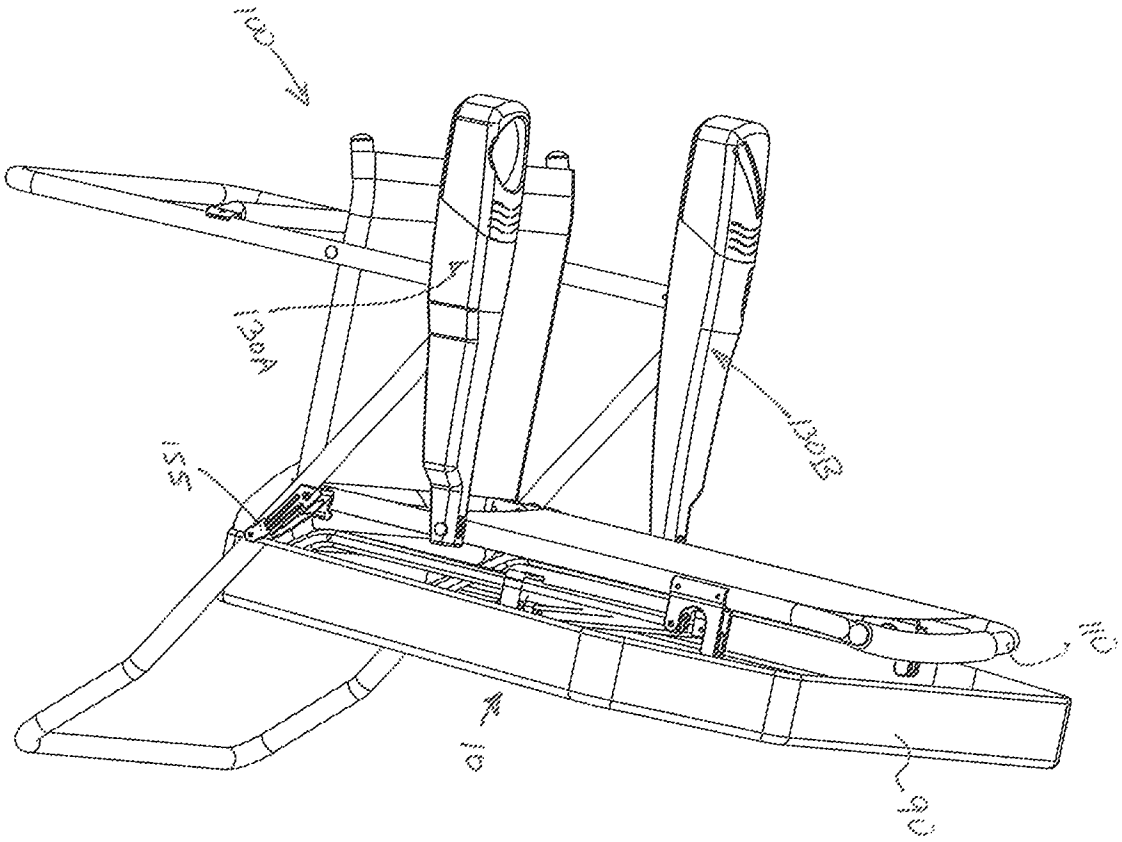
FIG. 9 is yet another view highlighting the canopy assembly shown in FIG. 4 in its stowed position.
Figure 11:
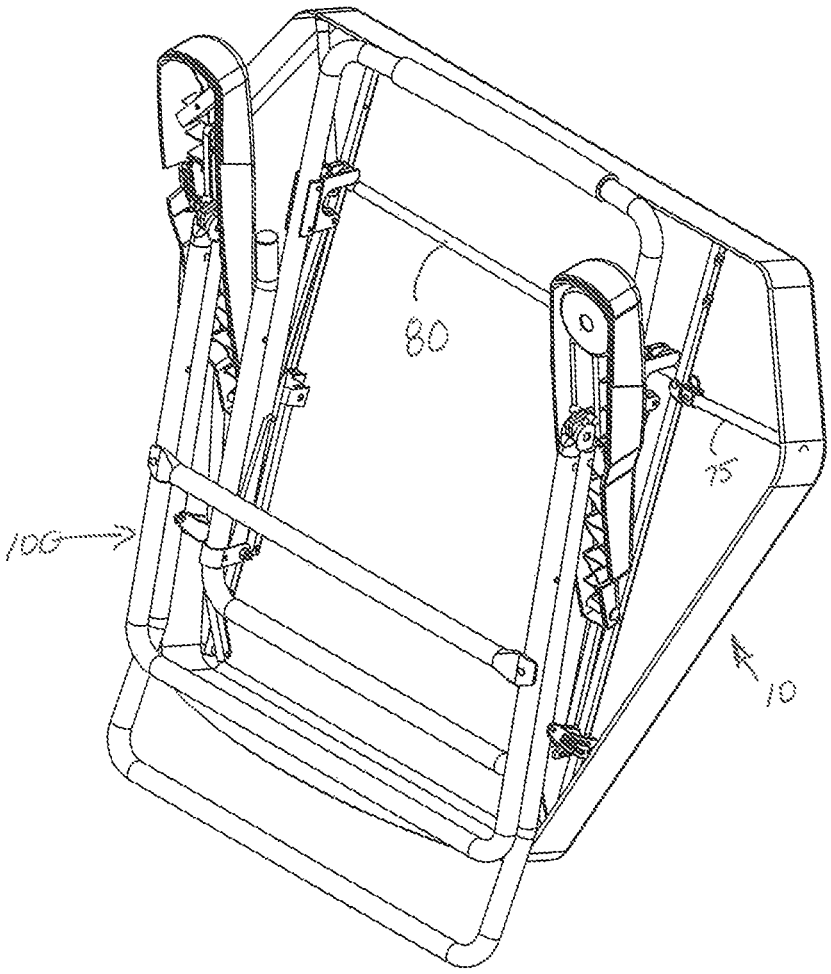
FIG. 11 is yet another view highlighting a chair and the canopy assembly shown in FIG. 4 in its stowed position.

It should thus be clear that as preferably constructed, the U-shaped back frame 110, the U-shaped seat frame 105, the U-shaped front leg frame 115, and the U-shaped back leg frame 120 can be positioned in any number of positions, such as in an open position as shown in in FIGS. 7-9 and are likewise foldable towards each other, as illustrated in FIG. 10-11.

The foregoing should be understood to be a construction of a preferred folding chair for use in connection with the present invention. However, it should be clearly understood that other folding chairs are usable in connection with the present invention, as would be understood in the art.

Reference will now be made to canopy assembly, generally indicated at 10, shown in various positions of deployment as well as in a stowed position (e.g. FIG. 11).

Figure 4:
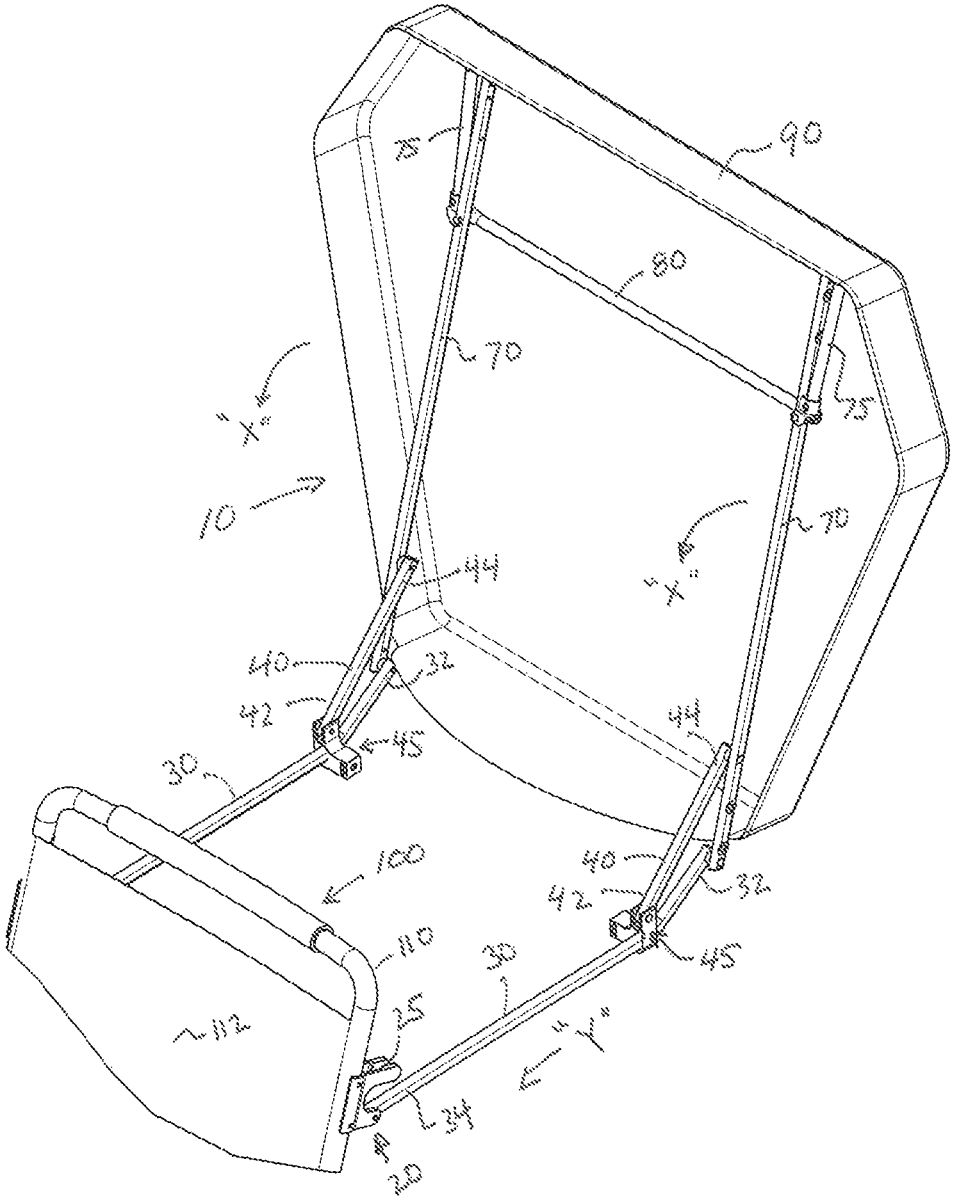
FIG. 4 is a view of a canopy assembly constructed in accordance with a preferred embodiment of the present invention.
Figure 5:
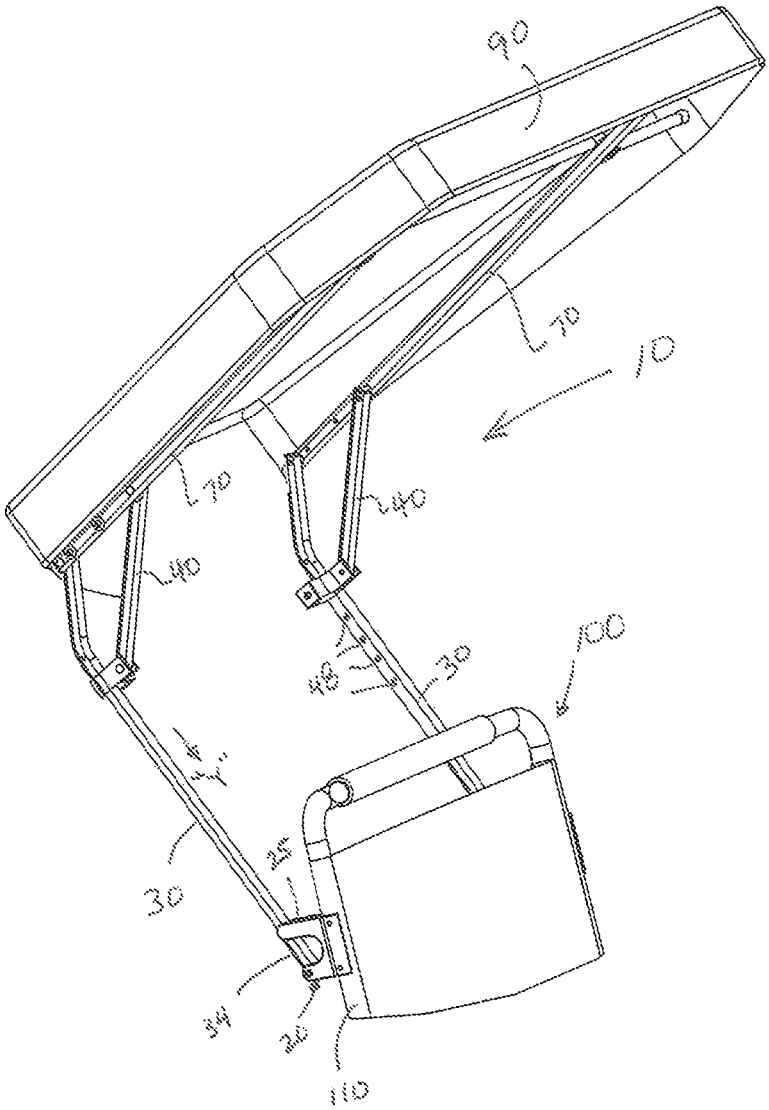
FIG. 5 is another view of the canopy assembly as shown in FIG. 4.

For example, as first illustrated in FIGS. 4 and 5, canopy assembly 10 is preferably coupled to the folding chair 100 by two (2) spaced apart mounting fixtures, generally indicated at 20. Mounting fixtures 20 may be clipped, e.g. releasable or nonreleasably, or may be more securely coupled to the chair and preferably to the sides of the back frame 110 by means of e.g. rivets, screws or the like. Respective arms 30 are pivotably coupled to the mounting fixtures 20 as can also be seen in U.S. Pat. No. 8,186,755, the subject matter of which is incorporated by reference as if fully set forth herein. First and second spaced apart canopy supports, generally indicated at 70, are respectively connected to the respective first arms 30 at each of the first ends 32 thereof. The respective other ends 34 of the arms 30 are coupled to the respective mounting fixtures 20. Each mounting fixture is provided with a receptacle or slot 25 for releasably coupling, e.g. by friction fit or snap-fit, the respective arm 30 therein. In this way, each arm 30 can be rotated so as to be releasably lockable in/out of the/its respective associated mounting fixture 20.

Spaced apart and respective braces, generally each indicated at 40, are coupled intermediate the respective canopy supports 70 and arms 30. Preferably, each first end 42 of each brace 40 is coupled to the respective arm 30 preferably by a slidable coupler 45, while the other respective ends 44 of brace 40 may be simply coupled to the respective canopy supports 70 by a pin, rivet, screw/nut combination, or the like. In this way, as the two (2) canopy supports 70 are rotated in the direction of arrow "X" (e.g. FIG. 4), the slidable coupler 45 on each arm 30 will slide along arm 30 in the direction of arrow "Y." This will allow the canopy supports 70, which supports fabric (or other material) canopy 90 (which itself is preferably secured about and/or to and stretched over the canopy supports 70), to fold inwardly towards its stowed position (e.g. FIGS. 8, 9, 10, 11).

In accordance with the present invention, canopy assembly 10 comprises a cross-member, generally indicated at 80, which is preferably (but not necessarily) made of a single piece of metal, metal alloy, plastic and/or combinations of the foregoing. Cross-member 80 may be coupled and/or otherwise connected between the cross members 70 with rivets, screw/nut combinations and/or any other known means of coupling or connecting the cross member to the supports 70. Constructing cross-member 80 as a rigid member, such as a one (1) piece metal member, a metal alloy member, plastic and/or combinations of the foregoing, allows for always maintaining a predetermined spaced relationship between canopy supports 70, and thus adds to the structural integrity of the canopy assembly 10, especially when the canopy assembly 10 is rotated throughout its range of positions, e.g. from its stowed position (FIGS. 10, 11) to its deployed position (e.g. FIGS. 4, 5, 6, 7) and visa versa. In this way, the canopy assembly 10 is provided with additional and constant structural support especially when used with a folding chair of the U-type shape 100 as disclosed herein.

FIG. 5 also shows another feature incorporated into the present invention, namely wherein each slidable coupler 45 is independently slidable along arm 30 and wherein a plurality of detents 48 may be provided along arm 30 so as to selectively position the respective arms 30 there along.

Another feature disclosed herein is the use of respective extending swing arms 75 that are coupled to the respective canopy supports 70. Swing arms 75, when deployed, serve to further extend a portion of canopy 90 so as to provide additional shade or cover as desired.

Figure 6:
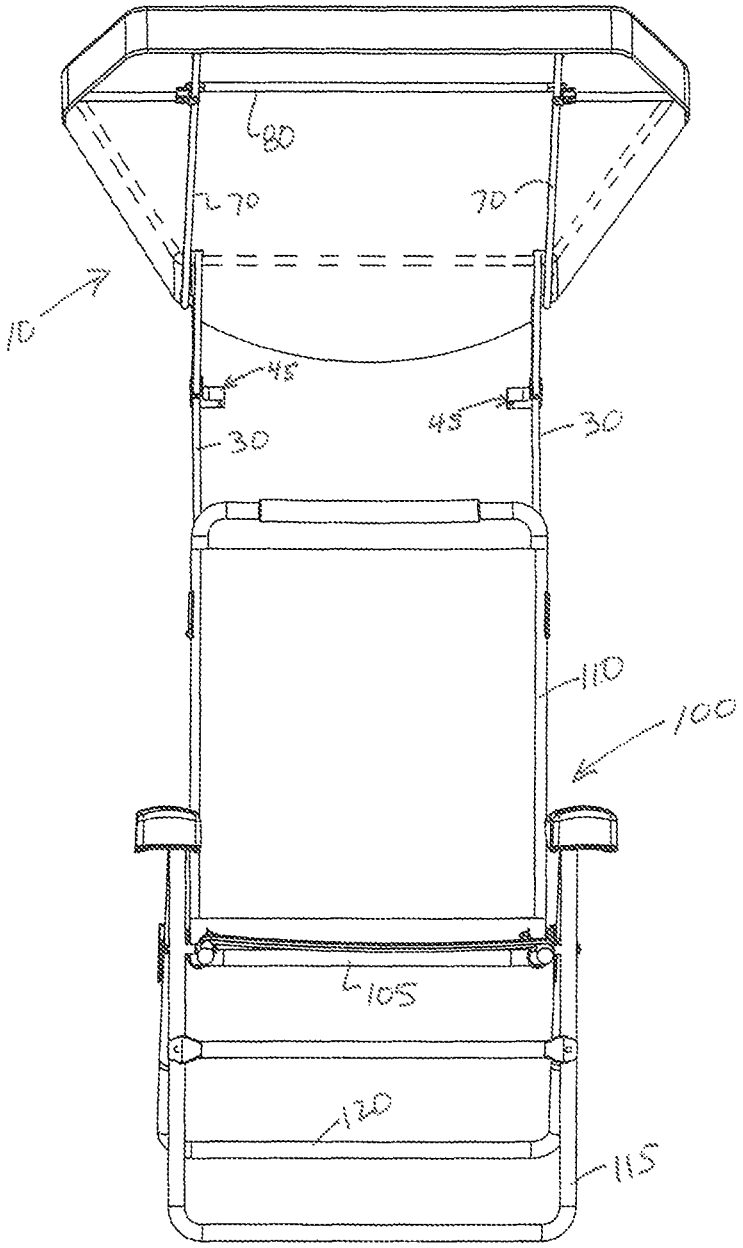
FIG. 6 is yet another view highlighting aspects of the canopy assembly shown in FIG. 4.

FIG. 6 is provided to show canopy assembly 10 in a deployed position, further showing the inclusion of the cross-member 80 which is providing the additional and constant structural integrity to the canopy assembly in the deployed position. FIG. 7 also shows canopy assembly 10 in a deployed position, further showing the canopy supports 70 in a more downward angle so as to show the versatility of providing different angles of shade to a person sitting in chair 100. FIG. 8 particularly highlights the rotation of arms 30 away from the mounting fixtures 20 as well as the further rotation of canopy supports 70 towards the arms 30 so as to collapse the canopy assembly 10 for its stowed position. FIG. 8 also shows the exemplary increased and constant structural integrity and maintenance thereof by virtue of the inclusion of the cross-member 80 being a one (1) piece member as disclosed herein. FIGS. 9, 10 show the convenient and closely collapsed (i.e. stowed) position achievable by the canopy assembly 10 towards the back of the chair 100. Again, the incorporation of the preferred one (1) piece cross-member 80 as disclosed herein helps maintain the structural integrity of the canopy assembly 10 as it is in its stowed position, and importantly, the incorporation of a single member/non-collapsible cross-member 80 helps maintain the constant structural integrity of the canopy assembly 10 when both the canopy assembly 10 and the chair 100 are in their respective stowed positions, as shown herein. For example, FIG. 11 shows both the canopy assembly 10 and the chair 100 simultaneously in their respective collapsed and stowed positions, i.e. the canopy assembly 10 in its fully stowed position for storage and/or transport and the chair 100 in its fully collapsed and stowed position for storage and/or transport. For clarity and ease of understanding, the back support panel 112 and the seat panel 107 have been removed in FIG. 11 so that the reader can clearly see crossmember 80, which has not been reduced in length and maintains the same distance between the supports 70 regardless of whether the canopy assembly 10 is in its deployed and/or stowed positions.

As should now be appreciated, the benefits of the present invention over the prior art examples are numerous, including but not limited to providing a canopy assembly with increased and constant structural integrity during use/deployment or during storage or transport. In particular, using a one (1) piece member for cross-member 80 in a canopy assembly 10 for use with a U-shaped chair such as that disclosed herein provides for increased and constant structural integrity of the canopy assembly 10 when the chair 100 is in its stowed position, which has not heretofore been realized or appreciated.

In particular, the use of a cross-member 80 being of a one (1) piece member and unable to be collapsed between the first and second canopy supports to which the cross member is coupled provides increased structural support when the chair and the canopy assembly are both in their respective stowed positions. Preferably, as should be understood, the cross-member 80 of the preferred embodiments does not include any hinge along the length thereof such that the distance between the first and second canopy supports cannot be decreased from the predetermined spaced distance when at least the canopy assembly itself is in its stowed position, but preferably and also when the canopy assembly and the chair are both in their respective stowed positions.

As thus should now be understood by those skilled in the art, the present invention overcomes all of the aforementioned deficiencies while also providing the advantages mentioned herein as well as those advantages that should be understood by those skilled in the art.

Other advantages and objectives are deemed to be apparent from the disclosure herein. It should also be appreciated that the present invention can be implemented and utilized in numerous ways. While the present invention has been described with respect to preferred embodiments, those skilled in the art will readily appreciate that various changes and/or modifications can be made to the invention without departing from the spirit or scope of the invention.

What is claimed is:

1. A combination canopy assembly and a chair, wherein the canopy assembly comprises:

a first mounting fixture and a second mounting fixture each coupled to the chair;

a first arm and a second arm, each arm having a first end and a second end, wherein the first end of each arm is pivotably coupled to a respective mounting fixture;

a first canopy support and a second canopy support, wherein the second end of each arm is coupled to a respective canopy support;

a first brace and a second brace, each brace coupled between a respective arm and canopy support, with a first end of each brace being coupled to the respective arm with a slidable coupler so as to permit the rotation of the first and second canopy supports relative to the first and second arms, and wherein each slidable coupler together with the first end of the respective brace coupled thereto will slide along it associated arm when the first and second canopy supports are rotated towards the respective first and second arms;

a cross-member coupled intermediate the first and second canopy supports, for maintaining the first and second canopy supports at a predetermined spaced distance from each other, wherein the cross-member is a one piece member and unable to be collapsed between the first and second canopy supports to which the cross-member is coupled; and a canopy that is supported by at least the first canopy support and the second canopy support; wherein:

when the canopy assembly is in a deployed position, the cross-member maintains the first and second canopy supports at the predetermined spaced distance from each other; and when both the canopy assembly and the chair are in their respective stowed positions, the cross-member maintains the first and second canopy supports at the predetermined spaced distance from each other.

2. The combination canopy assembly and a chair as claimed in claim 1, wherein the cross-member does not include any hinge along the length thereof; and wherein the distance between the first and second canopy supports cannot be decreased from the predetermined spaced distance when the canopy assembly and the chair are in their respective stowed positions.

3. The combination canopy assembly and a chair as claimed in claim 1, wherein the chair comprises a frame and wherein the frame is comprised of:

a U-shaped seat frame coupled to a U-shaped back frame, a U-shaped front leg frame coupled to a U-shaped back leg frame, and together being coupled to a first arm rest and a second arm rest at respective ends of said U-shaped front leg frame and U-shaped back leg frame, wherein the first and second arm rests are pivotally coupled at respective first ends to the U-shaped back frame;

and a coupler for coupling the U-shaped back frame to the U-shaped back leg frame;

wherein the U-shaped front leg frame is coupled to the U-shaped seat frame, and wherein the U-shaped back frame, the U-shaped seat frame, the U-shaped front leg frame, and the U-shaped back leg frame are foldable towards each other.

4. The combination canopy assembly and a chair as claimed in claim 3, wherein the U-shaped front leg frame, the U-shaped back frame, the U-shaped seat frame, and the U-shaped do not change their individual shapes when the chair is in its stowed position.

5. The combination canopy assembly and a chair as claimed in claim 3, wherein the chair is in its stowed position when the U-shaped back frame, the U-shaped seat frame, the U-shaped front leg frame, and the U-shaped back leg frame are folded towards each other.

6. A canopy assembly for a chair, the assembly comprising:

a first mounting fixture and a second mounting fixture;

a first arm and a second arm, each arm having a first end and a second end, wherein the first end of each arm is pivotably coupled to a respective mounting fixture;

a first canopy support and a second canopy support, wherein the second end of each arm is coupled to a respective canopy support;

a first brace and a second brace, each brace coupled between a respective arm and canopy support, with a first end of each brace being coupled to the respective arm with a slidable coupler so as to permit the rotation of the first and second canopy supports relative to the first and second arms, and wherein each slidable coupler together with the first end of the respective brace coupled thereto will slide along it associated arm when the first and second canopy supports are rotated towards the respective first and second arms;

a cross-member coupled intermediate the first and second canopy supports, for maintaining the first and second canopy supports at a predetermined spaced distance from each other, wherein the cross-member is a one piece member and unable to be collapsed between the first and second canopy supports to which the cross-member is coupled; and a canopy that is supported by at least the first canopy support and the second canopy support; wherein:

when the canopy assembly is in a deployed position, the cross-member maintains the first and second canopy supports at the predetermined spaced distance from each other; and when the canopy assembly is in its stowed position, the cross-member maintains the first and second canopy supports at the predetermined spaced distance from each other.

7. The canopy assembly as claimed in claim 6, wherein the cross-member does not include any hinge along the length thereof;

wherein the distance between the first and second canopy supports cannot be decreased from the predetermined spaced distance when the canopy assembly is in its stowed position.

* * * * *